United States Patent [19]

Imai et al.

[11] 4,362,104

[45] Dec. 7, 1982

[54] FLEXOGRAPHIC PRINTING PRESS

[75] Inventors: Hiroto Imai, Fukuyama; Sumito Arima, Mihara, both of Japan

[73] Assignee: Mitsubishi Jukogyo Kabushiki Kaisha, Tokyo, Japan

[21] Appl. No.: 155,784

[22] Filed: Jun. 2, 1980

[30] Foreign Application Priority Data

Jun. 5, 1979 [JP] Japan ..... 54-70239

[51] Int. Cl.[3] ..... B41F 31/00

[52] U.S. Cl. ..... 101/349; 101/206; 101/363

[58] Field of Search ..... 101/350, 363, 148, 219, 101/221, 206, 207, 208, 209, 349, 351, 352; 74/675, 665 M, 665 B, 674, 705; 118/210, 262

[56] References Cited

U.S. PATENT DOCUMENTS

| | | | |
|---|---|---|---|
| 1,234,403 | 7/1917 | Smith | 101/350 |
| 2,377,354 | 6/1945 | Merritt | 74/705 X |
| 3,769,909 | 11/1973 | Fugman et al. | 101/363 X |
| 4,043,265 | 8/1977 | Grobman | 101/350 |

*Primary Examiner*—Edgar S. Burr

*Assistant Examiner*—Charles A. Pearson

*Attorney, Agent, or Firm*—Bernard, Rothwell & Brown

[57] ABSTRACT

Flexographic printing press for printing on the corrugated board sheets passing between the printing cylinder provided with a form plate on its peripheral surface and the receiving roll. Flexographic ink stored between a doctor roll and an anilox roll, which are rotated in the opposite directions as these rolls contact each other, is supplied to said form plate via said anilox roll to thereby carry out a printing operation. Said anilox roll is driven by said printing cylinder at same peripheral speed. Said doctor roll is driven by a speed change drive mechanism for reducing the peripheral speed of said doctor roll when the rotational speed of said anilox roll is increased, and increasing the peripheral speed of said doctor roll when the rotational speed of said anilox roll is decreased. The preferred speed change drive mechanism consists of a differential gear means having an output shaft connected to said doctor roll, a motor for driving said differential gear means and means for transmitting the force of rotation of said anilox roll to said differential gear means.

3 Claims, 6 Drawing Figures

PRIOR ART

FLEXOGRAPHIC PRINTING PRESS

BACKGROUND OF THE INVENTION

1. Field of the Invention

The invention relates to flexographic printing press for printing on corrugated board sheet.

2. Description of the Prior Art

A schematic diagram of a conventional flexographic printing press of a general type is shown in FIG. 1 and a plan view in section of an ink roll portion of the press shown in FIG. 1 is shown in FIG. 2.

In the flexographic printing press shown in FIG. 1, a material 1 to be printed is passed between a printing cylinder or roll 3 to which a form plate 2 is attached, and a receiving roll 4 to thereby subject the material 1 to printing.

Flexographic ink 7 is supplied to an ink reservoir formed by a doctor roll 5 and an anilox roll 6.

The doctor roll 5 is driven at a predetermined speed, which is lower than the peripheral speed of the anilox roll 6, by a worm reducing electric motor 8 via sprocket wheels 9, 10 and a chain 11 to transfer ink uniformly to the anilox roll 6.

The anilox roll 6 is driven by the printing roll 3 at the same peripheral speed as the printing roll 3 via a gear 13 containing a one-way clutch 12 therein.

Accordingly, as the operational speed, i.e. the number of revolution per minute of the printing cylinder 3, is increased, the number of revolution per minute of the anilox roll 6 is increased. As a result, the flow rate of ink passed between the doctor roll 5 and anilox roll 6 is increased in accordance the hydrostatic law so that the amount of ink transferred to the surface of the anilox roll 6 is increased.

Consequently, the flow rate of ink varies depending upon the operational speed of the printing cylinder.

This causes variations in thickness of printed matter. When the printing cylinder is rotated at a high speed, ink is transferred to the form plate at an unduly high rate so that beautiful printed matter can hardly be obtained. Moreover, such printed matter is not dried in a short time.

SUMMARY OF THE INVENTION

Thus, an object of the present invention is to eliminate the above-described drawbacks encountered in conventional flexographic printing press.

Another object of the present invention is to provide a flexographic printing press which permits obtaining beautiful printed matter even when the printing cylinder is rotated at a high speed and which permits obtaining printed matters which are dried in a shorter period of time.

In carrying out the invention, there is provided a doctor roll and an anilox roll rotated in the opposite directions as these rolls contact each other. Flexographic ink stored between said doctor roll and said anilox roll is supplied to a form plate attached to a printing cylinder, via the anilox roll to thereby carry out a printing operation. The anilox roll is driven by said printing cylinder at same peripheral speed. The doctor roll is driven by a speed change drive mechanism for reducing the peripheral speed of said doctor roll when the rotational speed of said anilox roll is increased, and increasing the peripheral speed of said doctor roll when the rotational speed of said anilox roll is decreased. The preferred speed change drive mechanism consists of a differential gear means having an output shaft connected to said doctor roll, a motor for driving said differential gear means and means for transmitting the force of rotation of said anilox roll to said differential gear means.

Since the present invention is constructed as described above, flexographic ink is not unnecessarily transferred to the anilox roll even when the press, i.e. the anilox roll, is operated at a high speed. Accordingly, beautiful printed matter can always be obtained, and the ink on the sheet is dried in a short period of time.

DESCRIPTION OF THE PREFERRED EMBODIMENTS

An embodiment of the present invention will be described with reference to the accompanying drawings.

Figure 3:
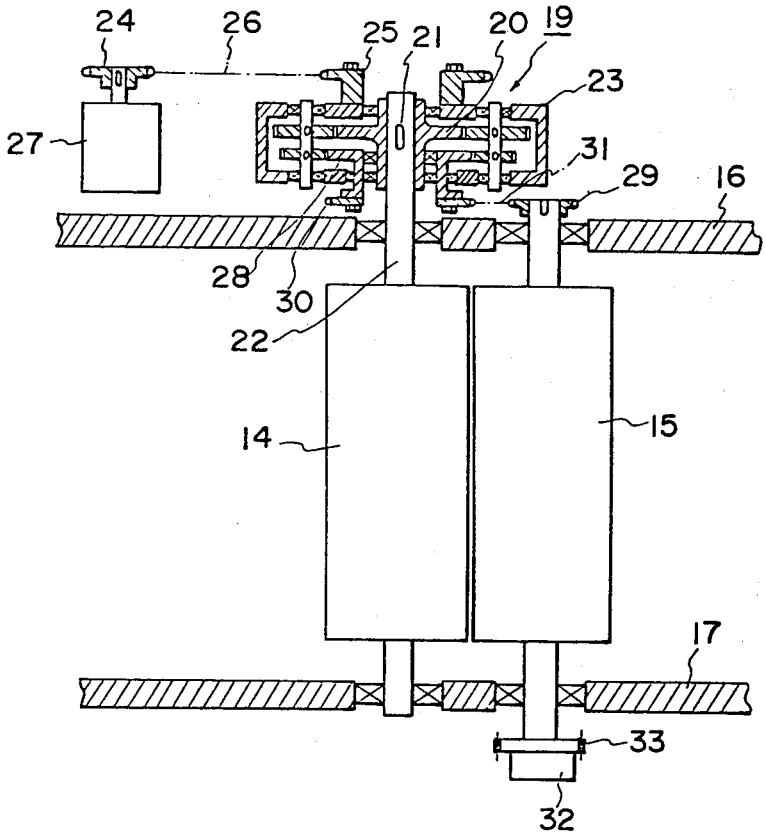
FIG. 3 is a plan view in section of a flexographic printing press constructed in accordance with a first preferred embodiment of the present invention.

In the first embodiment of the present invention shown in FIG. 3, a doctor roll 14 and an anilox roll 15 are mounted on the respective shafts, which are rotatably supported at both end portions thereof on a driving side frame 16 and a control side frame 17 such that the doctor roll 14 and anilox roll 15 can be rotated in the opposite directions as these rolls contact each other. Ink 18 (which is not shown in FIG. 3 but in FIG. 6) stored between the rolls 14, 15 is supplied to a form plate attached to a printing cylinder (not shown), via the anilox roll 15 to thereby carry out a printing operation.

A differential reduction means 19 is connected to one end of the doctor roll 14. A sun gear 20 constituting a part of the differential reduction means 19 is fixedly mounted with a key 21 on a doctor roll shaft 22, and a casing 23 of the differential reduction means 19 is connected to a variable speed motor 27 by means of sprocket wheels 24, 25 and a chain 26.

Another sun gear 28 provided in the casing 23 is connected to the anilox roll 15 by means of sprocket wheels 29, 30 and a chain 31. The anilox roll 15 is provided at the control side end portion of the shaft thereof with a gear 33 containing a one-way clutch 32 therein, and adapted to be driven by a printing cylinder gear (not shown).

The operation of the first embodiment will be described.

The function of the first embodiment is completely the same as that of a conventional flexographic printing press.

The doctor roll 14 is rotated by the differential reduction means 19 mounted on an end portion of the shaft 22 thereof at a composite speed of the number of revolutions per minute of the variable speed motor 27 and the number of revolutions per minute of the anilox roll 15.

On the other hand, the anilox roll 15 receives a rotational force from a printing cylinder gear (not shown) via the gear 33 which is mounted on the control side end portion of the shaft of the roll 15 and which contains a one-way clutch therein. Accordingly, as the operational speed is increased, the number of revolution per minute of the anilox roll 15 is increased.

Figure 4:
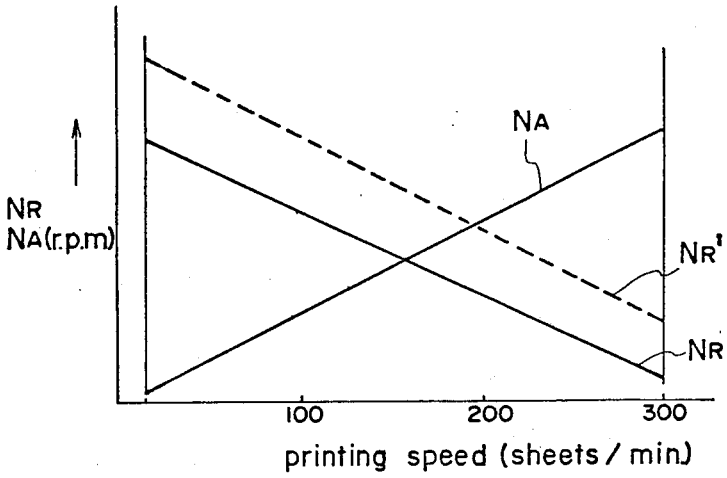
FIG. 4 is a graphic diagram showing the relationship between the operational speed of the flexographic printing press shown in FIG. 3 and the number of revolutions of an anilox roll and a doctor roll employed therein.

Therefore, assuming that the variable speed motor 27 is rotated at a predetermined number of revolutions per minute $N_M$, the number of revolutions per minute $N_R$ of the doctor roll 14 is decreased as shown in solid line in FIG. 4 as the number of revolutions per minute $N_A$ of the anilox roll 15 is increased.

When the number of revolution per minute of the variable speed motor is set to $N_M'$, the number of revolutions per minute $N_R'$ of the doctor roll 14 is varied as shown in broken line in FIG. 4 in accordance with variations in the number of revolutions per minute of the anilox roll 15.

Namely, the peripheral speed of the doctor roll 14 can be varied in the opposite direction synchronously with respect to variations in the peripheral speed of the anilox roll 15 (when the anilox roll 15 is accelerated, the doctor roll 14 is decelerated).

Figure 5:
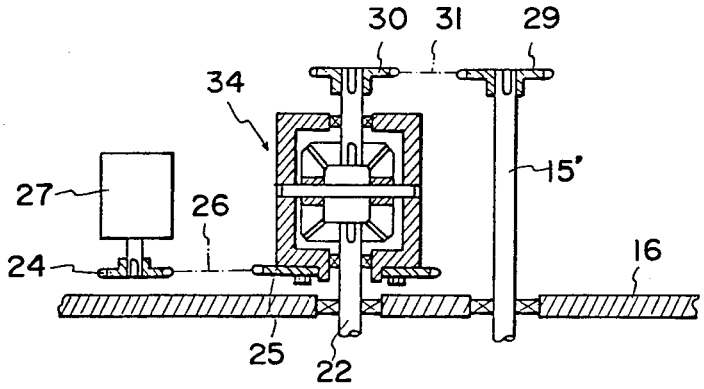
FIG. 5 is a section view of another embodiment of the present invention.

FIG. 5 shows another embodiment of the present invention, in which the planetary gear type differential gear means 19 shown in FIG. 3 is substituted by a bevel gear type differential gear means.

In this embodiment, the rotation of a variable speed motor 27 is transmitted to a doctor roll shaft 22 via sprocket wheels 24, 25, a chain 26 and a differential gear means 34, and the rotation of an anilox roll shaft 15' is transmitted to the doctor roll shaft 22 via sprocket wheels 29, 30, a chain 31 and the differential gear means 34. This embodiment has the same effect and advantages as the first embodiment.

A flexographic printing press according to the present invention may be provided in addition to the speed variable motor with a detection means (not shown) for use in detecting the peripheral speed of the anilox roll 15, and a control means for use in controlling the number of revolutions per minute of the speed variable motor by means of a signal from the detection means so as to allow the transfer rate of ink to be maintained at a constant level.

Figure 6:
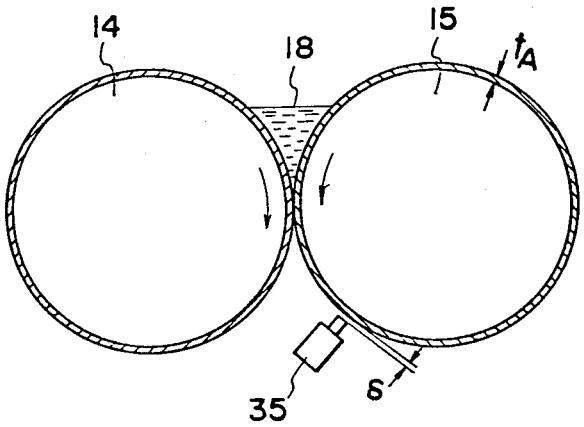
FIG. 6 is a side elevational view in section of still another embodiment of the present invention.

Still another embodiment of the present invention having, instead of the above-mentioned detection means for detecting the peripheral speed of the anilox roll, a detection means 35 for use in detecting the amount of ink transferred to an anilox roll 15 is shown in FIG. 6.

This ink amount detection means may consist of a density meter (when the transferred amount of ink is increased, the density of ink is also increased) or a non-contact type means for detecting a gap $\delta$ by utilizing a laser beam or supersonic wave or with reference to variations in electrostatic volume.

The above-mentioned means for detecting the peripheral speed of the anilox roll may be omitted; the printing density on a printed sheet may be measured with a density meter to automatically or manually control the number of revolutions per minute of the variable speed motor.

Experiments were conducted by changing the number of revolutions per minute of the anilox roll 15 and doctor roll 14 in various ways to find out the following.

The amount of ink transferred to the anilox roll 15 and the number of revolution per minute of the anilox roll and doctor roll 14 have the following relationship:

$$t_A = K_O N_A^{\alpha} (N_A + N_R)^{\beta}$$

wherein $t_A$ represents the thickness of a layer of ink on the surface of the anilox roll; and $K_O$, $\alpha$, $\beta$ represent constants determined by the nipping pressure, viscosity of ink, hardness of rubber and diameters of rolls.

Figure 1:
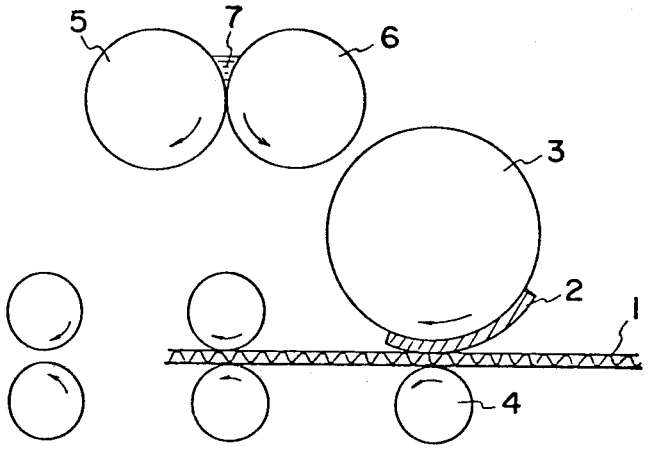
FIG. 1 is a schematic diagram in side elevation of a conventional flexographic printing press of a general type.
Figure 2:
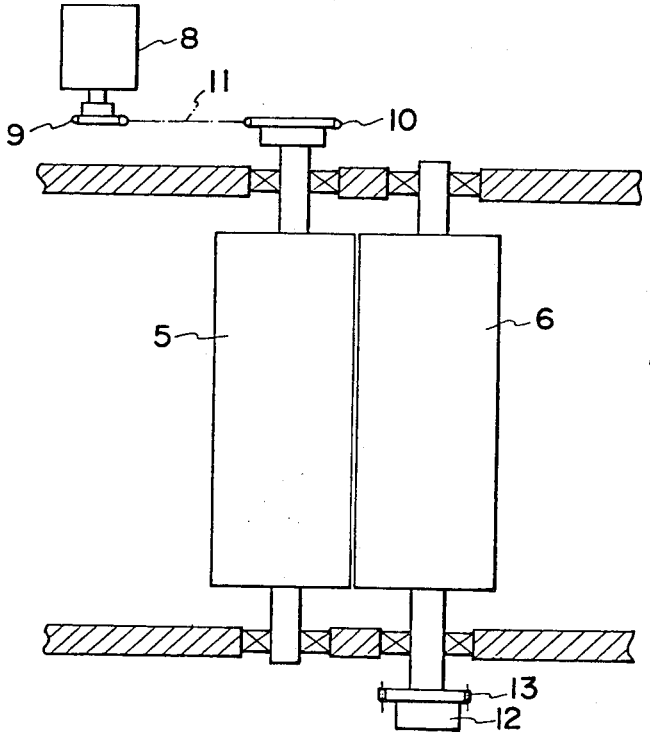
PRIOR ART FIG. 2.
FIG. 2 is a plan view in section of an ink roll portion of the flexographic printing press shown in FIG. 1.

Since a flexographic printing press according to the present invention is constructed as described above, a total number of revolutions per minute $(N_A+N_R)$ of the doctor roll and anilox roll does not vary to a great extent in accordance with variations in the operational speed, namely variations in the number of revolutions per minute $N_A$ of the anilox roll. Therefore, the thickness $t_A$ of a film of ink on the surface of the anilox roll varies only proportionally to the alpha-th power of the number of revolutions per minute $N_A$ of the anilox roll. On the other hand, with a conventional flexographic printing press (in FIG. 2), the total number of revolutions per minute $(N_A+N_R)$ of the doctor roll and anilox roll also varies in accordance with variations in the operational speed because the number of revolutions per minute $N_R$ of the doctor roll is constant, and so the thickness $t_A$ varies also in proportion to the beta-th power of the total number of revolutions per minute $(N_A+N_R)$ in addition to the variation with the alpha-th power of $N_A$ as in the present invention. Therefore, according to the present invention, the variation of the printing density between one at high speed operation and one at low speed operation can be controlled within a range small enough for practical usage.

According to the present invention, ink is not unnecessarily transferred to the anilox roll even when the press is operated at a high speed. Accordingly, beautiful printed matter can always be obtained, and the ink on the sheet is dried in a short period of time.

The doctor roll used in the present invention can be rotated in the opposite direction synchronously with respect to the anilox roll while changing the peripheral speed of the former roll in various ways with respect to the peripheral speed of the latter roll. Consequently, a total number of revolutions of the doctor roll and anilox roll can be regulated freely so that an optimum printing condition in accordance with a desired printing density can be selected.

Since many changes and modifications could be made in the above-described constructions without departing from the spirit of the present invention, it is intended that all matter described in the specification and illustrated in the accompanying drawings shall be interpreted as illustrative and not in a limiting sense. It is intended therefore to cover, by the appended claims, all modifications coming within the spirit and scope of this invention.

What is claimed is:

1. A flexographic printing press wherein ink stored between an anilox roll and a doctor roll which are in contact with each other and which are rotated in opposite rotational directions is supplied via said anilox roll to a form plate attached to a printing cylinder, to thereby carry out a printing operation, comprising a speed change drive mechanism for reducing the peripheral speed of said doctor roll when the peripheral speed of said anilox roll is increased, and increasing the peripheral speed of said doctor roll when the peripheral speed of said anilox roll is decreased.

2. A flexographic printing press according to claim 1, wherein said speed change drive mechanism comprises of a differential gear means having an output shaft connected to said doctor roll, motor for driving said differential gear means and means for transmitting the force of rotation of said anilox roll to said differential gear means.

3. A flexographic printing press according to claim 2, wherein said motor consists of a variable speed motor.

* * * * *